US007204925B2

(12) United States Patent
Matsumura et al.

(10) Patent No.: US 7,204,925 B2
(45) Date of Patent: Apr. 17, 2007

(54) STRUCTURE AND METHOD OF PREVENTING ELECTROLYTIC CORROSION FOR MAGNESIUM ALLOY MEMBER

(75) Inventors: Sadaharu Matsumura, Wako (JP); Tsuyoshi Kawabe, Wako (JP); Tetsuya Saito, Tokyo (JP); Katsumi Sakamoto, Tokyo (JP); Ryosuke Kamegamori, Kanagawa (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 408 days.

(21) Appl. No.: 10/487,141

(22) PCT Filed: Aug. 20, 2002

(86) PCT No.: PCT/JP02/08385

§ 371 (c)(1),
(2), (4) Date: Feb. 23, 2004

(87) PCT Pub. No.: WO03/018873

PCT Pub. Date: Mar. 6, 2003

(65) Prior Publication Data

US 2004/0206635 A1 Oct. 21, 2004

(30) Foreign Application Priority Data

Aug. 22, 2001 (JP) ..... 2001-251006

(51) Int. Cl.
*C23C 28/00* (2006.01)

(52) U.S. Cl. ..... 205/198; 205/199; 205/149; 205/191; 205/194; 205/196; 205/317; 205/318; 205/319; 205/320; 205/333; 411/378; 411/82.2; 411/901; 411/902; 411/903

(58) Field of Classification Search ..... 411/378, 411/82.2, 903; 204/196.01, 196.24, 196.31, 204/196.17, 196.18, 196.19; 205/149, 191, 205/194, 196, 198, 199, 317, 318, 319, 320, 205/333

See application file for complete search history.

(56) References Cited

U.S. PATENT DOCUMENTS 6,209,409 B1 * 4/2001 Kitahata et al. ..... 74/388 PS
6,323,264 B1 * 11/2001 Nazaryan et al. ..... 523/458
2002/0127083 A1 * 9/2002 Ando et al. ..... 411/378

FOREIGN PATENT DOCUMENTS

| | | |
|---|---|---|
| JP | 56-015872 | 2/1981 |
| JP | 05-125567 | 5/1993 |
| JP | 2001-206235 | 7/2001 |

* cited by examiner

*Primary Examiner*—Bruce F. Bell
(74) *Attorney, Agent, or Firm*—Arent Fox PLLC

(57) ABSTRACT

A structure and a method of preventing electrolytic corrosion for a magnesium alloy member (20), the structure wherein a first coated layer (11) formed by electro deposition and a second coated layer (12) formed by distributing PTFE particles on the first coated layer (11) are covered on the surface of a tightening member (1) at least on a surface coming into contact with the magnesium alloy member (20), whereby, the electrolytic corrosion of the magnesium alloy member can be prevented at a low cost by insulating a tightening member such as a steel bolt and a washer from the magnesium alloy member, and an adhesiveness therebetween can be sufficiently assured.

10 Claims, 5 Drawing Sheets

STRUCTURE AND METHOD OF PREVENTING ELECTROLYTIC CORROSION FOR MAGNESIUM ALLOY MEMBER

TECHNICAL FIELD

The present invention relates to a technology for preventing the occurrence of electrolytic corrosion in fastening parts in a fastening structure for a magnesium alloy member and a fastening member made of a metal other than that of the magnesium alloy member.

BACKGROUND ART

In the automobile industry, recently, there have been an increasing demands for fuel economy as concerns about environmental problems mount. To meet such demands, the automobile industry is researching ways to reduce the weight of car bodies, and is attempting to increase the use of magnesium alloy in automotive parts because of it is lightest in weight among metals which may be practically used. Recently, in particular, it has been research for use in parts demanding very high corrosion resistance, such as the outer housing and structural parts.

However, since magnesium alloy is the most common practical alloy, when fastened together with different metals such as iron and aluminum, electrolytic corrosion is likely to occur in the presence of moisture containing electrolytes. In particular, in the engine space and at the underside of an automobile, electrolytic corrosion is extremely promoted by the action of electrolytes contained in rainwater, melting snow, salt, etc., and problems, that is, loosening, may occur in the fastened parts. Hitherto, as disclosed in Japanese Patent No. 2715758, aluminum washers were insulated by anodic oxidation, or bolts were coated with resin as disclosed in Japanese Patent Publication No. S58-40045.

However, anodic oxidation of aluminum washers is very expensive. In the case of coating bolts with resin, contact adhesion of resin coating films on bolts and durability are insufficient, and the coating film may peel off, resulting in electrolytic corrosion, and improvement in contact adhesion is required.

DISCLOSURE OF THE INVENTION

It is therefore an object of the invention to provide a structure and a method for resistance to electrolytic corrosion which can assure sufficient contact fastening of a magnesium alloy member securely and at low cost while preventing electrolytic corrosion by insulating a fastening member such as steel bolt or washer.

The structure which is resistant to electrolytic corrosion for an magnesium alloy member of the invention is characterized by coating at least the surface of a fastening member which is to contact with the magnesium alloy member with a first coating layer by electro deposition, and coating a second coating layer having polytetrafluoroethylene particles (PTFE particles) dispersed therein on the first coating layer.

The method of preventing electrolytic corrosion of a magnesium alloy member of the invention is characterized by the steps of applying a first coating layer by electro deposition on at least the surface of a fastening member which is to contact the magnesium alloy member, and a step of applying a second coating layer having PTFE particles dispersed therein on the first coating layer, thereby forming a crosslinking structure of the first coating layer and second coating layer.

According to the invention, the first coating layer formed by electro deposition has outstanding contact adhesion on the fastening member and outstanding durability compared with conventional dip coatings. Therefore, the first coating layer is difficult to peel off the surface of the fastening member, and electrolytic corrosion is thereby prevented effectively. The second coating layer formed by disposing PTFE particles is crosslinked to the first coating layer and is firmly adhered to the first coating layer. The second coating layer has extremely low frictional resistance, and the contact adhesion and durability thereof are extremely high. In addition, since the second coating layer is water repellent, the electrolytic corrosion preventive effects and weatherability of the coating are enhanced.

When the fastening member is a bolt, since the frictional resistance is low, variation in friction in fastening is reduced. Accordingly, the fastening torque is stable when fastening the bolt, variations in the axial force of the bolt are suppressed, and a uniform axial force is obtained. Hitherto, it was difficult to obtain a uniform axial force in a completely degreased state, or in a state contaminated with coolant, rust preventive, or other oil or grease, or when surface conditions varied; however, since the second coating layer forming the surface has low frictional resistance and is water repellent, a uniform axial force is obtained, regardless of surface conditions.

The material for the first coating layer of the invention includes various resins such as cationic or anionic epoxy, acrylic, polybutadiene, and alkyd resins; cationic epoxy resins are preferably used from the viewpoint of high corrosion resistance and contact adhesion. The thickness of the first coating layer should be 5 μm or more in order to assure contact adhesion and durability; however, if the thickness exceeds 50 μm, uniform thickness may not be obtained, and improvement of effect is not expected, and the electro deposition consumes too much energy. Therefore, the thickness of the first coating layer is preferred to be 5 to 50 μm, or more preferably 20 to 50 μm. When forming the first coating layer on the fastening member, in the case in which the fastening member is made of steel, it is preferred to form a base coat by forming a film of phosphate or black oxide. As the base coat, a Zn or Cr plating may also be applied.

The second coating layer of the invention is formed by dispersing PTFE particles in a synthetic resin and an organic solvent such as alcohol or ketone in order to adhere more firmly to the first coating layer, and drying, and the concentration of PTFE particles in the solvent is, for example, 1 to 30%. At this time, the content of the synthetic resin is preferred to be 10 to 50% of the solid content of the PTFE. In order that the second coating layer may exhibit a desired low frictional coefficient, the molecular weight of PTFE particles is preferred to be 1000 or less, and the particle size should be 1 μm or less. The thickness of the second coated layer is preferred to be 1 to 10 μm in order to obtain durability and stability of frictional torque. These materials for the first coating layer and second coating layer are inexpensive, and therefore the invention is realized at low cost.

FIG. 1 is a sectional view showing the concept of the invention, in which a base coat 2 is applied on the surface of a fastening member 1 such as a steel bolt, and a cationic epoxy resin is applied on the surface of the base coat 2 by electro deposition, and a first coating layer 11 is formed.

After drying the first coating layer 11, the first coating layer 11 is immersed for a specified time in a solvent in which PTFE particles are dispersed, and the first coating layer 11 and second coating layer 12 are heated and cured. By curing, the PTFE particles are crosslinked and held on the surface of the first coating layer 11, and a crosslinked structure is formed. The fastening member 1 is fastened when the second coating layer 12 contacts magnesium alloy member 20.

BEST MODE FOR CARRYING OUT THE INVENTION

Actions and effects of the invention are described below with reference to an embodiment.

(1) Test by Ring-on-Disk Method

A. Adhesion Test of Surface Layer

Figure 1:
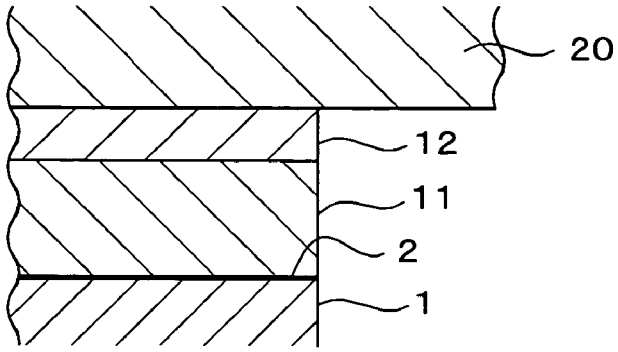
FIG. 1 is a sectional view showing schematically structure for preventing electrolytic corrosion of the invention.
Figure 2A:
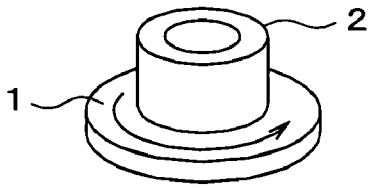
FIG. 2 is a diagram explaining the testing method by a ring-on-disk method, in which (a) is a perspective view of a test piece, and (b) is a side view showing the device schematically.
Figure 2B:
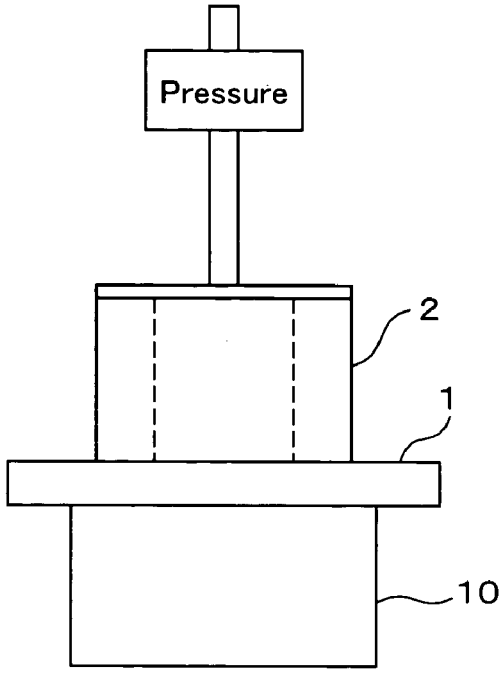

Referring first to FIG. 2, the testing method by a ring-on-disk method is explained. Test pieces are disk 1 and ring 2 as shown in FIG. 2(*a*), and as shown in FIG. 2(*b*), while rotating the disk 1 about the shaft by a drive source 10, the end face of the ring 2 is pressed against a surface thereof at a specified pressure, and changes of frictional torque on the basis of the driving torque for rotating the disk 1 are measured.

Figure 3:
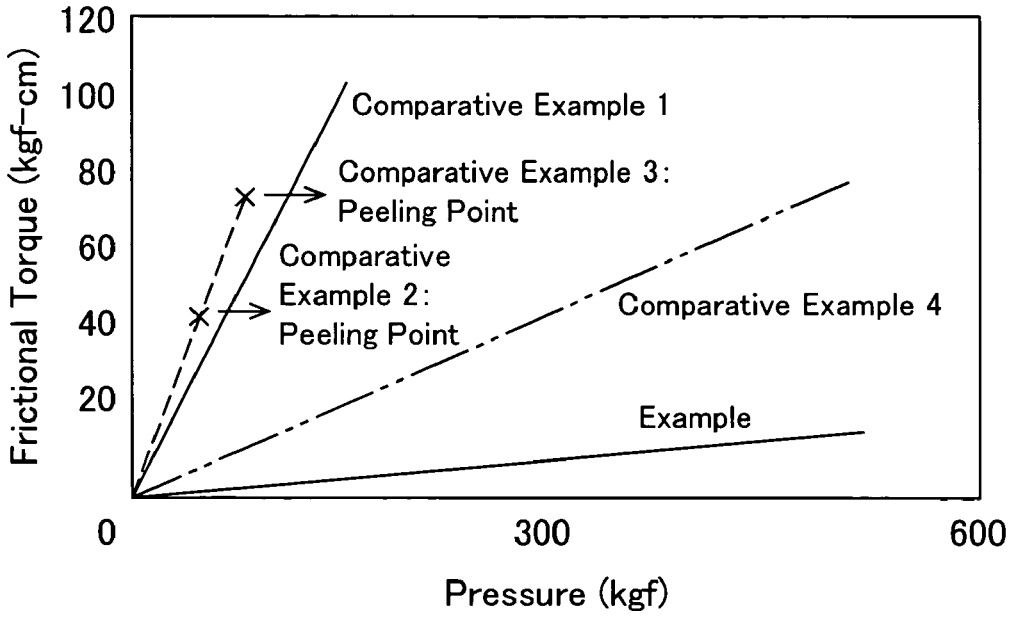
FIG. 3 is a diagram showing results of contact adhesion of the Example and the Comparative Examples by the ring-on-disk method.

According to the descriptions shown in Table 1, coating layers were formed on the surface of steel disks 50 mm in diameter and 1 mm thick, and test pieces of the Example and Comparative Examples 1 to 4 were obtained. While rotating the disks about the shaft at a speed of 20 rpm, the end face of a magnesium alloy ring of Ra 0.13 to 0.20 μm, 20 mm inner diameter and 25.6 mm outer diameter was pressed against the surface, and while raising the pressing load at a rate of 100 kgf/min, changes in frictional torque (kgf-cm) on the basis of the driving torque for rotating the disk were measured. Results of measurement are shown in FIG. 3.

TABLE 1

| | Coating layer 1 | Coating method | Baking condition | Coating layer 2 | Coating method | Baking condition |
|---|---|---|---|---|---|---|
| Example | Cationic epoxy | Electro deposition | 150° C. 10 min | PTFE disperse solution | Dip | 190° C. 30 min |
| Comparative Example 1 | Cationic epoxy | Electro deposition | 190° C. 30 min | None | — | — |
| Comparative Example 2 | Solvent type epoxy | Dip | 190° C. 40 min | None | — | — |
| Comparative Example 3 | Anionic epoxy | Electro deposition | 190° C. 40 min | None | — | — |
| Comparative Example 4 | Cationic epoxy | Electro deposition | 190° C. 30 min | PTFE disperse solution | Dip | 190° C. 30 min |

The strength resisting shear peeling is judged to be inferior when the frictional torque is high as compared with the load of the ring, and excellent when the frictional torque is low. As shown in FIG. 3, in Comparative Example 1, the frictional torque rises in a range of relatively low load, and in Comparative Examples 2 and 3, the first coating film peels off at a lower load. In these Comparative Examples 1 to 3 in which only the first coating layer is formed, the coating layer formed by immersing the solvent type epoxy resin (Comparative Example 2) is worst in contact adhesion, and the adhesion is increased in the order of the coating layer formed by electro deposition of anionic epoxy (Comparative Example 3) and the coating layer formed by electro deposition of cationic epoxy (Comparative Example 1). That is, the cationic epoxy is preferred as the resin and the electro deposition is recommended as the forming method. In Comparative Example 4 coated with the second coating layer after curing the first coated layer, the frictional torque is higher than in the Example of the crosslinked structure of the first coating layer and second coating layer, and the contact adhesion is inferior. In the Example, if the load is increased, the frictional torque is increase only very slightly, and the contact adhesion is excellent as compared with the Comparative Examples.

B. Adhesion Test of Each Coating Layer in the Example

Figure 4:
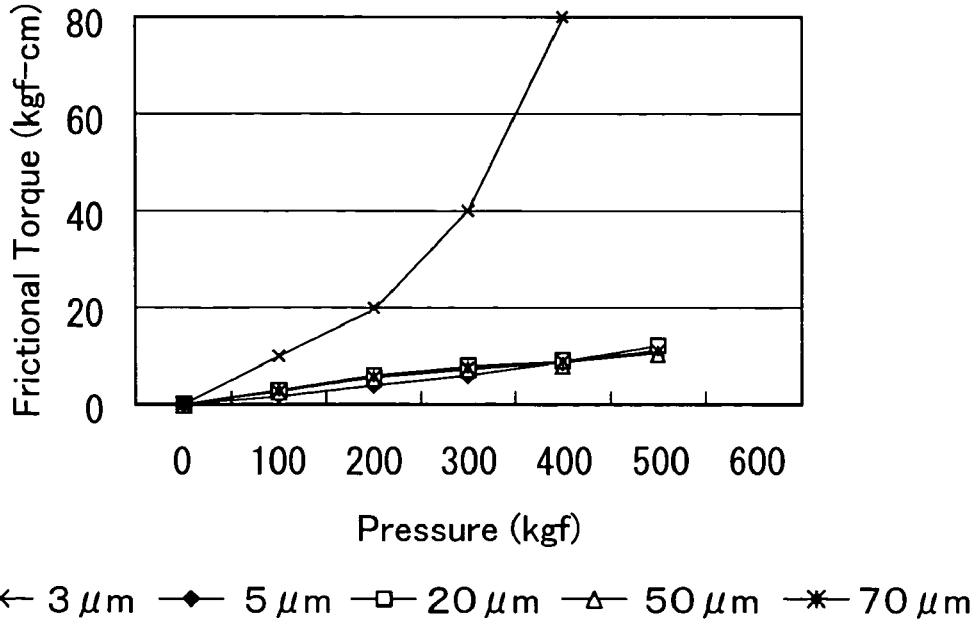
FIG. 4 is a diagram showing results of contact adhesion of the first coating layer in the Example by the ring-on-disk method.
Figure 5:
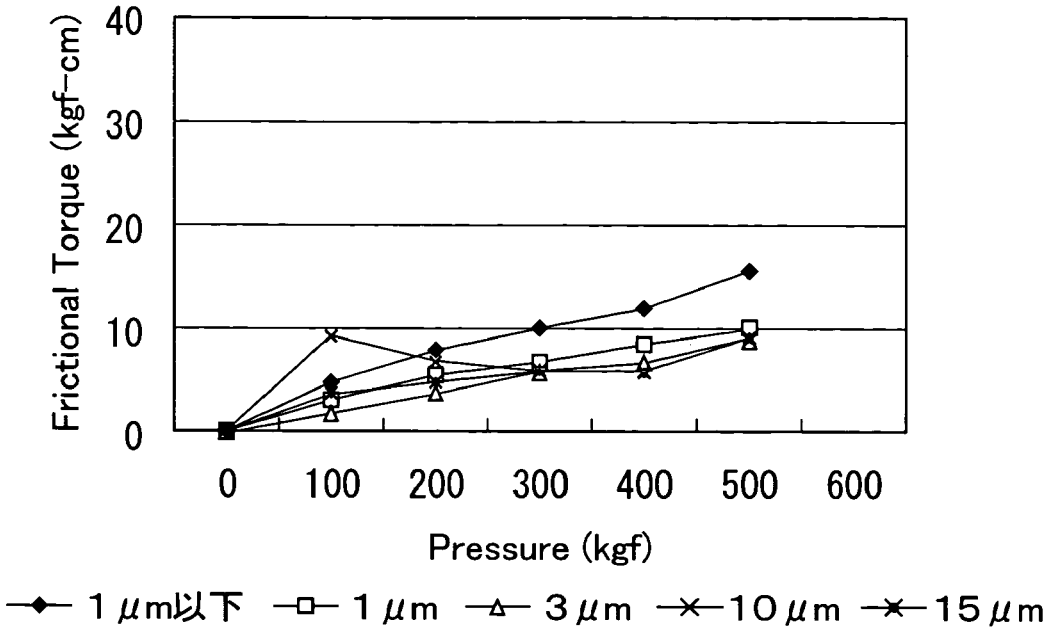
FIG. 5 is a diagram showing results of contact adhesion of the second coating layer in the Example by the ring-on-disk method.

In the Example, the first coating layer was prepared in five thicknesses of 3 μm, 5 μm, 20 μm, 50 μm, and 70 μm, and in these first coating layers, the frictional torque was measured similarly by the ring-on-disk method. Furthermore, the second coating layer to be laminated on the first coating layer was prepared in five thick of less than 1 μm, 1 μm, 3 μm, 10 μm, and 15 μm, and in these second coating layers, the frictional torque was measured similarly by the ring-on-disk method. Results of the first coating layers are shown in FIG. 4, and the results for the second coating layers are given in FIG. 5. According to FIG. 4, in the thickness range of the first coating layer of 5 to 50 μm, there is no significant change in contact adhesion, and a favorable adhesion is assured. According to FIG. 5, in the thickness range of the second coating layer of 1 to 10 μm, uniformity of frictional torque was confirmed.

(2) Durability Test of Resin by Salt Spray Test

A base coat was applied on the surface of steel test pieces, and the first coating layer was formed on the base coat by electro deposition of resins, such as cationic or anionic epoxy resin, acrylic resin, polybutadiene resin, and alkyd resin, and salt water was sprayed on the coating layers for a specified time, and occurrence of rust was investigated. The test method conforms to JIS K 5400. Results are shown in Table 2. In Table 2, results were evaluated as ◎: no rust, ○: small spots of rust, and Δ: signs of rust, but no practical problems.

TABLE 2

| | Epoxy resin | Acrylic resin | Polybutadiene resin | Alkyd resin |
|---|---|---|---|---|
| Pencil hardness | 3H | 2H | 2H | H |
| Salt spray resistance | ◎ | ○ | ○ | Δ |

According to Table 2, the coating layer of epoxy resin was not torn by pencil of hardness 3H, and therefore, it was high in strength. The coating layers by acrylic resin and polybutadiene resin were strong enough by a pencil of hardness 2H, and the coating layer by alkyd resin had no practical problem by a pencil of hardness H. Therefore, these resins can be used as resins for the first coating layer, and in particular, the cationic epoxy resin is most suitable.

(3) Water Repellence Test

Purified water was dropped on the surface of the Example and Comparative Examples 1 and 2 with a drop diameter of 2 mm, and the contact angle of the water drop on each coating layer was measured. Results are shown in Table 3. The larger the contact angle, the higher is the water repellence.

TABLE 3

| Example | Comparative Example 1 | Comparative Example 2 |
|---|---|---|
| 120° | 51° | 101° |

According to Table 3, the second coating layer of the Example is superior in water repellence to the coating layer of the prior art. As compared with the first coating layer, the second coating layer of the Example is extremely improved in water repellence, and the effect of the second coating layer as a dispersed layer of PTFE particles was observed.

(4) Measurement of Axial Force

Figure 6:
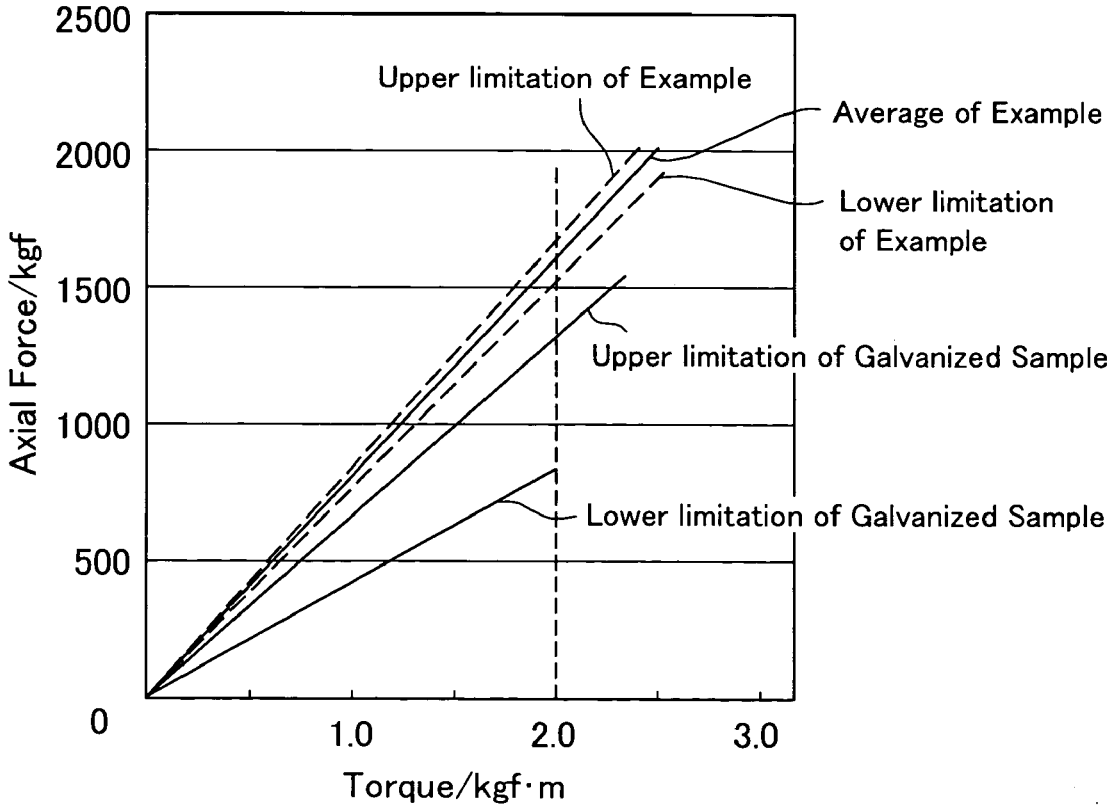
FIG. 6 is a diagram showing changes of axial force in the Example and in the prior art.

Plural samples were prepared by forming the coating layer by applying the Example on M8 flanged bolts, and these were engaged and fastened with nut members, and the fastening torque and axial force were measured. Conventional samples which were galvanized were similarly tested. Results are shown in FIG. 6. According to FIG. 6, as compared with conventional galvanized samples, variations in axial force were slight in the bolts of the Example, and therefore adequate torque control was judged to be possible.

(5) Measurement of Axial Force (Comparison Between Oiled State and Degreased State)

Figure 7:
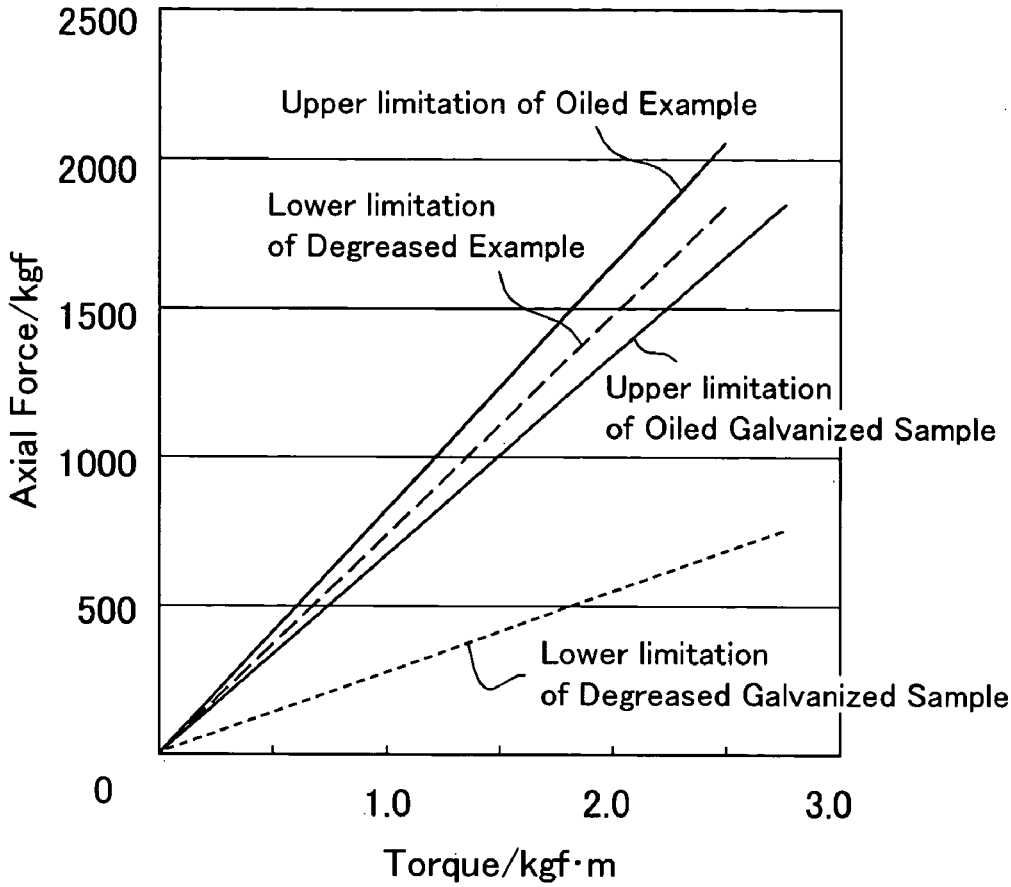
FIG. 7 is a diagram showing changes in axial force in an oiled state and in a degreased state of the Example and the prior art.

Plural samples were prepared by forming the coating layer by applying the Example on M8 flanged bolts, and these were tested in an oiled state and in a degreased state, and the fastening torque and axial force were measured. Conventional samples which were galvanized were similarly tested. Results are shown in FIG. 7. According to FIG. 7, as compared with conventional galvanized samples, the axial force of the bolt of the Example was not significantly different between the oiled state and the degreased state, and the water repellence was excellent, and a uniform axial force could be obtained regardless of the surface condition.

(6) Test by Ball-on-Disk Method

Figure 8:
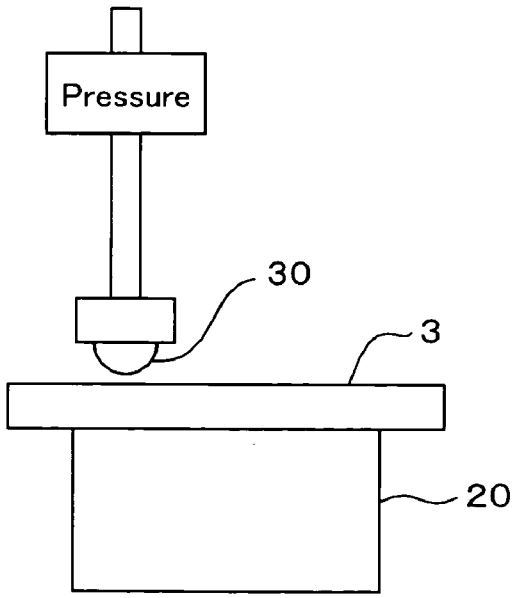
FIG. 8 is a schematic side view of a testing device of the ball-on-disk method.
Figure 9:
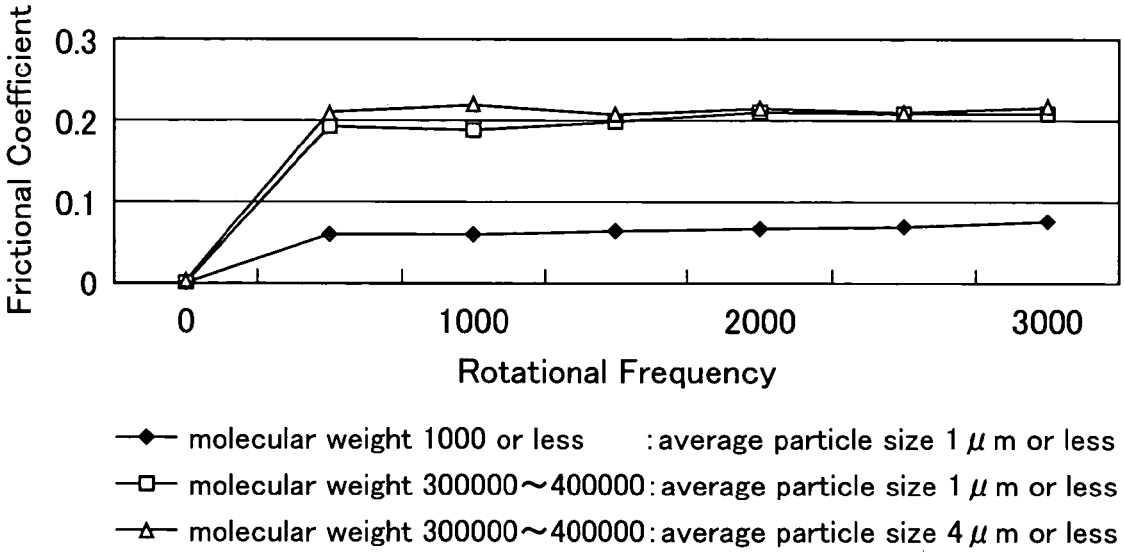
FIG. 9 is a diagram showing results of testing changes of frictional coefficient of the Example by the ball-on-disk method.

As the second coating layer, dispersed layers of three types of PTFE particles which were different in molecular weight and particle size were used, and their frictional coefficients were measured by the ball-on-disk method. In the ball-on-disk method, as shown in FIG. 8, while rotating a disk 3 of magnesium alloy about the shaft by a drive source 20, a steel ball 30 with a diameter of 10 mm on which was formed the second coating layer was pressed and rolled. The force of the ball 30 pulled in the rotating direction was detected by a sensor, and the frictional coefficient was measured on the basis of this force. In this case, the load of the ball 30 pressed to the disk 3 was 100 g, and the speed of the disk 3 for rolling the ball 30 was 0.2 m/sec. The three types of PTFE particles had a molecular weight of 1000 or less with an average particle size of 1 μm or less, a molecular weight of 300,000 to 400,000 with an average particle size of 1 μm or less, and a molecular weight of 300,000 to 400,000 with an average particle size of 4 μm. Results are shown in FIG. 9. According to FIG. 9, in the case of PTFE particles with a molecular weight of 1000 or less with an average particle size of 1 μm or less, the frictional coefficient was smaller by far compared with the other two types of PTFE particles, and therefore such PTFE particles were confirmed to be most suitable.

The invention claimed is:

1. A structure for preventing electrolytic corrosion of a magnesium alloy member, the structure preventing electrolytic corrosion of the magnesium alloy member in contact with a fastening member of a dissimilar material, characterized by:

a first coating layer formed by electro deposition on at least the surface of the fastening member contacting the magnesium alloy member, and a second coating layer having polytetrafluoroethylene particles dispersed on the first coating layer.

2. The structure for preventing electrolytic corrosion of a magnesium alloy member according to claim 1, wherein the material of said first coating layer is a cationic epoxy resin.

3. The structure for preventing electrolytic corrosion of a magnesium alloy member according to claim 1, wherein the thickness of said first coating layer is 5 to 50 μm.

4. The structure for preventing electrolytic corrosion of a magnesium alloy member according to claim 1, wherein the thickness of said first coating layer is 20 to 50 μm.

5. The structure for preventing electrolytic corrosion of a magnesium alloy member according to claim 1, wherein the thickness of said second coating layer is 1 to 10 μm.

6. A method for preventing electrolytic corrosion of a magnesium alloy member, allowing a magnesium alloy member to contact a fastening member of a dissimilar material, characterized by the steps of:

applying a first coating layer by electro deposition on at least the surface of a fastening member contacting the magnesium alloy member, and applying a second coating layer having polytetrafluoroethylene particles dispersed on the first coating layer, thereby forming a crosslinked structure of the first coating layer and second coating layer.

7. The method for preventing electrolytic corrosion of a magnesium alloy member according to claim 6, wherein the material of said first coating layer is a cationic epoxy resin.

8. The method for preventing electrolytic corrosion of a magnesium alloy member according to claim 6, wherein the thickness of said first coating layer is 5 to 50 μm.

9. The method for preventing electrolytic corrosion of a magnesium alloy member according to claim 6, wherein the thickness of said first coating layer is 20 to 50 μm.

10. The method for preventing electrolytic corrosion of a magnesium alloy member according to claim 6, wherein the thickness of said second coating layer is 1 to 10 μm.

* * * * *